US008405481B2

(12) United States Patent
Renteria

(10) Patent No.: US 8,405,481 B2
(45) Date of Patent: Mar. 26, 2013

(54) WOVEN WIRE, INDUCTIVE DEVICES, AND METHODS OF MANUFACTURING

(75) Inventor: Victor H. Renteria, Poway, CA (US)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 13/033,523

(22) Filed: Feb. 23, 2011

(65) Prior Publication Data

US 2011/0205009 A1 Aug. 25, 2011

Related U.S. Application Data

(60) Provisional application No. 61/307,367, filed on Feb. 23, 2010.

(51) Int. Cl.
*H01F 27/28* (2006.01)

(52) U.S. Cl. ..... 336/189; 336/187; 336/188

(58) Field of Classification Search ..... 336/181, 336/182, 183, 187, 188, 189, 221
See application file for complete search history.

(56) References Cited

U.S. PATENT DOCUMENTS 3,069,601 A * 12/1962 Eidam ..... 361/160
3,256,417 A * 6/1966 Merrett ..... 219/675
3,275,966 A * 9/1966 Ashby, Jr. et al. ..... 336/181
3,283,280 A * 11/1966 Fischer ..... 336/187
3,359,518 A * 12/1967 Stein ..... 336/70
3,371,300 A * 2/1968 Stein ..... 336/70
3,391,365 A * 7/1968 Tipton ..... 336/70
3,673,530 A * 6/1972 Van Nice ..... 336/70
3,985,310 A 10/1976 Kent et al.
4,276,102 A * 6/1981 Schaeffer et al. ..... 156/85
4,603,314 A * 7/1986 Fukunaga et al. ..... 336/65
4,874,916 A 10/1989 Burke
5,411,646 A * 5/1995 Gossett et al. ..... 205/724
5,543,773 A 8/1996 Evans et al.
5,952,907 A 9/1999 McWilliams
6,225,560 B1 5/2001 Machado
6,593,839 B2 * 7/2003 Nakayama et al. ..... 336/182
6,603,234 B2 * 8/2003 Heyden et al. ..... 310/194
6,642,827 B1 11/2003 McWilliams et al.
7,598,837 B2 10/2009 Gilmartin
2006/0132272 A1 6/2006 Kitahara et al.
2009/0145628 A1 6/2009 Gifford et al.

* cited by examiner

*Primary Examiner* — Mohamad Musleh
*Assistant Examiner* — Joselito Baisa
(74) *Attorney, Agent, or Firm* — Gazdzinski & Associates, PC

(57) ABSTRACT

Low-cost, high performance woven conductors and associated inductive apparatus, and methods for manufacturing and utilizing the same. In one embodiment, an eight (8) conductor wiring strand is used that results in a pattern in which a given conductor resides, on average, at an equal position throughout the braid grouping as any other conductor within the wire strand over a given length. Such a configuration enhances coupling among the conductors, which minimizes deleterious parasitic effects such as leakage inductance and distributed capacitance. Segmented woven wiring strands are also disclosed which are composed of both woven and non-woven portions. Examples of devices which can utilize the woven conductors include, without limitation, bobbins or other formers, headers, encapsulated electronic packages, modular jacks, form-less inductive devices and transmission lines.

26 Claims, 8 Drawing Sheets

WOVEN WIRE, INDUCTIVE DEVICES, AND METHODS OF MANUFACTURING

PRIORITY

This application claims priority to U.S. Provisional Patent Application Ser. No. 61/307,367 filed on Feb. 23, 2010, of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to conductors and circuit elements and more particularly in one exemplary aspect to woven wire (e.g., as used with inductive devices), and methods of utilizing and manufacturing the same.

DESCRIPTION OF RELATED TECHNOLOGY

Transformers are devices that transfer electrical energy from one electrical circuit to another electrical circuit through the use of inductively coupled conductors. As is well understood, a varying current in a primary winding creates a varying magnetic flux and thus a varying magnetic field through a secondary winding. This varying magnetic field induces a varying electromotive force ("EMF") or voltage in the secondary winding. An ideal transformer assumes that all the magnetic flux generated by the primary winding is coupled to every secondary winding of the transformer. In practice however, some of the magnetic flux generated by the primary winding exists outside the secondary windings, thereby giving the appearance that the transformer has an inductance in series with the transformer windings. This non-ideal operating characteristic is known as leakage inductance.

Leakage inductance is caused by an imperfect coupling of the windings, and the creation of a leakage flux that does not link with all the turns of the secondary transformer windings. As a result, the voltage drops across the leakage reactance of the circuit resulting in a less than ideal voltage regulation, especially when the transformer is placed under load. This is particularly problematic in high frequency applications where the high frequency of the electrical current exacerbates the non-ideal parasitic effects seen in the transformer.

It has been recognized for years by engineers that reducing the amount of leakage inductance seen on a transformer increases the high frequency performance of the transformer. Heretofore, the most commonly used methods to reduce the amount of leakage inductance seen in a transformer has traditionally been by twisting the primary and secondary wires together, interleaving the windings (i.e. interspersing individual or layers of primary windings with secondary windings), or alternatively implementing a combination of both twisting an interleaving of the windings in order to increase the coupling between windings. The purpose of both twisting and interleaving techniques is to attempt to distribute electromagnetic energy (both internal and externally generated) to each of the primary and secondary windings as equally and as completely as possible. However, while it is possible to implement a combination of twisting and interleaving, twisting is often extremely difficult to accomplish when interleaving more than one set of windings. This is primarily a result of the fact that once you have more than one interleaved winding, then the order of the wires in the bundle needs to be carefully controlled in order to obtain the best coupling. This is often difficult to achieve when using both interleaving in combination with wire twisting.

FIG. 1 illustrates one such common prior art solution utilized in 1000 BaseT transformers, which uses a combination of both twisting and interleaving for the windings. In the illustrated embodiment, a cross-sectional view of four (4) wires that are twisted together is shown. Two (2) of the illustrated windings are for the primary (P) windings 110 and two (2) are for the secondary (S) windings 120. These windings are disposed, in the illustrated implementation, adjacent the surface of a flux carrying ferrite core 150. As can be seen, the primary wires are each equally distant to a given secondary wire, and vice versa. Because of this symmetry, the available electromagnetic energy is distributed evenly among the windings, thereby increasing the amount of coupling between the windings and reducing, inter alia, the leakage inductance.

However, although twisting and interleaving is a convenient means of ensuring the placement of primary windings next to secondary windings in configurations that use four (4) or less windings (or when used in lower frequency data applications), when designs utilize more than four (4) windings, or are utilized in higher frequency applications, the results become less predictable.

FIG. 2 illustrates a typical prior art 10 GBaseT transformer configuration that utilizes four (4) primary windings 210 and four (4) secondary windings 220. The number of respective primary and secondary windings has been increased so as to further reduce the effects of leakage inductance over the approach illustrated in FIG. 1, via the interleaving of additional conductors in parallel. However, a drawback of adding these additional conductors is that it becomes more difficult to maintain the positions for each conductor throughout the entire length of the winding strand. Accordingly, this difficulty in maintaining the position of the interleave from strand to strand results in varying amounts of coupling between the conductors and varying amounts of leakage inductance from transformer to transformer as a function of length along the strand. As can be seen in FIG. 2, it is no longer guaranteed that the primary windings 210 will always be adjacent and/or equidistant to the secondary windings 220 throughout the strand.

Moreover, while the difficulties of maintaining desired positioning among the conductors in a wire strand is exacerbated in eight (8) conductor implementations such as that of FIG. 2, inconsistencies in maintaining the same position for each conductor in the winding strand can also be present in applications that only include four (4) wires, as illustrated in FIGS. 3-3*e*. FIG. 3 shows the twisting and interleaving of four (4) conductors with two (2) primary windings 310, 315 and two (2) secondary windings 320, 325. The cross-sectional views for these windings (FIGS. 3*a*-3*e*) are shown at five (5) evenly distributed points along the illustrated portion of the winding strand 300. Ideally, the first primary winding 310 would remain equidistant with the first secondary winding 320 and the second secondary winding 325 through each of the various respective locations 350, 360, 370, 380 and 390. However, in practice this is frequently not the case. For example, position 360 (FIG. 3*b*) shows that the first primary winding 310 is now closer to the first secondary winding 320 then it is to the second secondary winding 325, rather then being equidistant to the two secondary windings as shown in FIG. 1, resulting in varying levels of coupling. Although, the use of four (4) conductors ensures that a primary winding will always be adjacent to a secondary winding (which is desirable), it is still not always possible to maintain the conductors so that each primary (or secondary) winding remains equidistant to the other windings.

Accordingly, despite the variety of prior art techniques for reducing the effects of winding parasitics in windings used in e.g., inductive devices, there is a salient need for winding configurations that are both low in cost to manufacture (such low cost being enabled by inter alia automated manufacturing techniques), and offer improved electrical performance over prior art devices. Ideally such a solution would not only offer very low manufacturing cost and improved electrical performance for the inductive device, but also provide a high level of consistency and reliability of performance by limiting opportunities for errors or other imperfections during manufacture of the windings.

SUMMARY OF THE INVENTION

In a first aspect of the invention, an inductive device is disclosed. In one embodiment, the inductive device includes conductive windings comprised of a primary sub-group and a secondary sub-group. The primary and secondary sub-groups are at least partly woven with one another.

In another embodiment, the inductive device has an electronic component element, and the inductive device is manufactured by the method comprising: obtaining a woven wiring strand comprised of a plurality of conductive wires; and disposing said woven wiring strand about said electronic component element.

In one variant, the woven wiring strand comprises both woven and un-woven portions and further comprises a period length, and is further divided into a plurality of equally spaced positions along said period length.

In another variant, each of said conductive wires resides, on average, substantially at the center of said woven wiring strand over a given period length.

In a second aspect of the invention, a woven wiring strand is disclosed. In one embodiment, the strand is comprised of a plurality of single-strand wires or conductors.

In a third aspect of the invention, an electronic apparatus that incorporates the aforementioned inductive devices is disclosed.

In a fourth aspect of the invention, methods of manufacturing the aforementioned device(s) and/or strand are disclosed.

In a fifth aspect of the invention, methods of using the aforementioned electronics apparatus are disclosed.

BRIEF DESCRIPTION OF THE DRAWINGS

The features, objectives, and advantages of the invention will become more apparent from the detailed description set forth below when taken in conjunction with the drawings, wherein.

Figure 1:
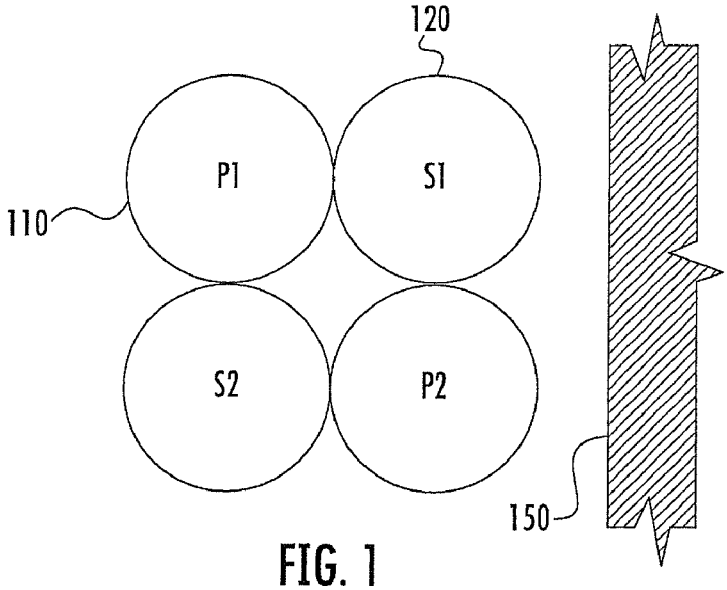
FIG. 1 (PRIOR ART)
FIG. 1 is a cross sectional view illustrating an exemplary four (4) conductor winding for a prior art 1000 BaseT transformer.

All Figures disclosed herein are © Copyright 2009 Pulse Engineering, Inc. All rights reserved.

DETAILED DESCRIPTION OF THE PREFERRED EMBODIMENT

Reference is now made to the drawings wherein like numerals refer to like parts throughout.

As used herein, the terms "bobbin" and "form" (or "former") are used without limitation to refer to any structure or component(s) disposed on or within or as part of an inductive device which helps form or maintain one or more windings of the device.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "inductive device" refers to any device using or implementing induction including, without limitation, inductors, transformers, and inductive reactors (or "choke coils").

As used herein, the terms "network" and "bearer network" refer generally to any type of data, telecommunications or other network including, without limitation, data networks (including MANs, PANs, WANs, LANs, WLANs, micronets, piconets, internets, and intranets), hybrid fiber coax (HFC) networks, satellite networks, cellular networks, and telco networks. Such networks or portions thereof may utilize any one or more different topologies (e.g., ring, bus, star, loop, etc.), transmission media (e.g., wired/RF cable, RF wireless, millimeter wave, optical, etc.) and/or communications or networking protocols (e.g., SONET, DOCSIS, IEEE Std. 802.3, 802.11, ATM, X.25, Frame Relay, 3GPP, 3GPP2, WAP, SIP, UDP, FTP, RTP/RTCP, H.323, etc.).

As used herein, the terms "network interface" or "interface" typically refer to any signal, data, or software interface with a component, network or process including, without limitation, those of the FireWire (e.g., FW400, FW800, etc.), USB (e.g., USB2, USB 3.0, USB On-the-Go, etc.), Ethernet (e.g., 10/100, 10/100/1000 (Gigabit Ethernet), 10-Gig-E, etc.), MoCA, optical (e.g., PON, DWDM, etc.), Serial ATA (e.g., SATA, e-SATA, SATAII), Ultra-ATA/DMA, Coaxsys (e.g., TVnet™), radio frequency tuner (e.g., in-band or OOB, cable modem, etc.), Wi-Fi (802.11a,b,g,n), WiMAX (802.16), PAN (802.15), IrDA, or other wireless families.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present invention provides, inter alia, improved woven conductor apparatus and methods for manufacturing, and utilizing the same within e.g., an inductive device. In an exemplary embodiment, an eight (8) conductor wiring strand that is woven is disclosed. The weaving technique that is used results in a pattern which places a given conductor at a consistent and substantially equal position throughout the length of the braid. In other words, for any given conductor over a length of wire, the position of that conductor within the braid is, on average, the same for each of the conductors.

Furthermore, the use of a weaving technique offers repeatable and predictable positioning of the conductors within the strand. Such a configuration enhances coupling among the conductors, which minimizes deleterious parasitic effects such as leakage inductance and distributed capacitance. In addition, the use of a weave also mitigates the effects of harmful externally generated electromagnetic interference (EMI). As a result, the use of woven conductors in applications such as gigabit Ethernet (GBE) transformer applications advantageously results in improved overall return loss performance, as well as improved consistency between devices, especially at higher device operating frequencies.

In addition to continuously woven wire strands, so-called "segmented" or composite woven wiring strands are also disclosed herein. These segmented strands are composed of both woven and non-woven portions. These segmented braids facilitate the manufacturing process for various electronic devices by, inter alia, (i) obviating the need to "de-braid" the woven conductors in order to terminate the ends of the conductors to, e.g., terminals on a bobbin or header; and (ii) providing multiple convenient and accessible points within a given woven strand at which the weave can be cleanly severed (i.e., so the cuts of each individual conductor are clean and substantially symmetric).

Examples of devices which can utilize the woven conductors include, without limitation, bobbins or other formers, headers, encapsulated electronic packages, modular jacks, form-less inductive devices, choke coils or inductive reactors and transmission lines.

DETAILED DESCRIPTION OF EXEMPLARY EMBODIMENTS

Detailed descriptions of the various embodiments and variants of the apparatus and methods of the invention are now provided. While primarily discussed in the context of utilization within eight (8) conductor transformer applications, the various apparatus and methodologies discussed herein are not so limited. In fact, many of the apparatus and methodologies described herein are useful with virtually any number of conductors (whether an even or an odd number) and with the manufacture of various non-transformer electrical components so long as the number of conductors and the non-transformer electrical components benefit from the woven wire manufacturing methodologies and apparatus described herein.

It is also noted that while described primarily in the context of embodiments which involve woven single or individual conductors or wires, the invention is in no way so limited, and in fact may be practiced with one or more constituent strands that are themselves multi-filar, and may be intertwined or woven.

In addition, it is further appreciated that certain features discussed with respect to specific embodiments can, in many instances, be readily adapted for use in one or more other contemplated embodiments that are described herein. It is readily recognized by one of ordinary skill, given the present disclosure that many of the features described herein possess broader usefulness outside of the specific examples and implementations with which they are described.

Woven Conductive Apparatus

Figures 4, 4A, 4B, 4C, 4D, 4E, 4F, 4G, 4H:
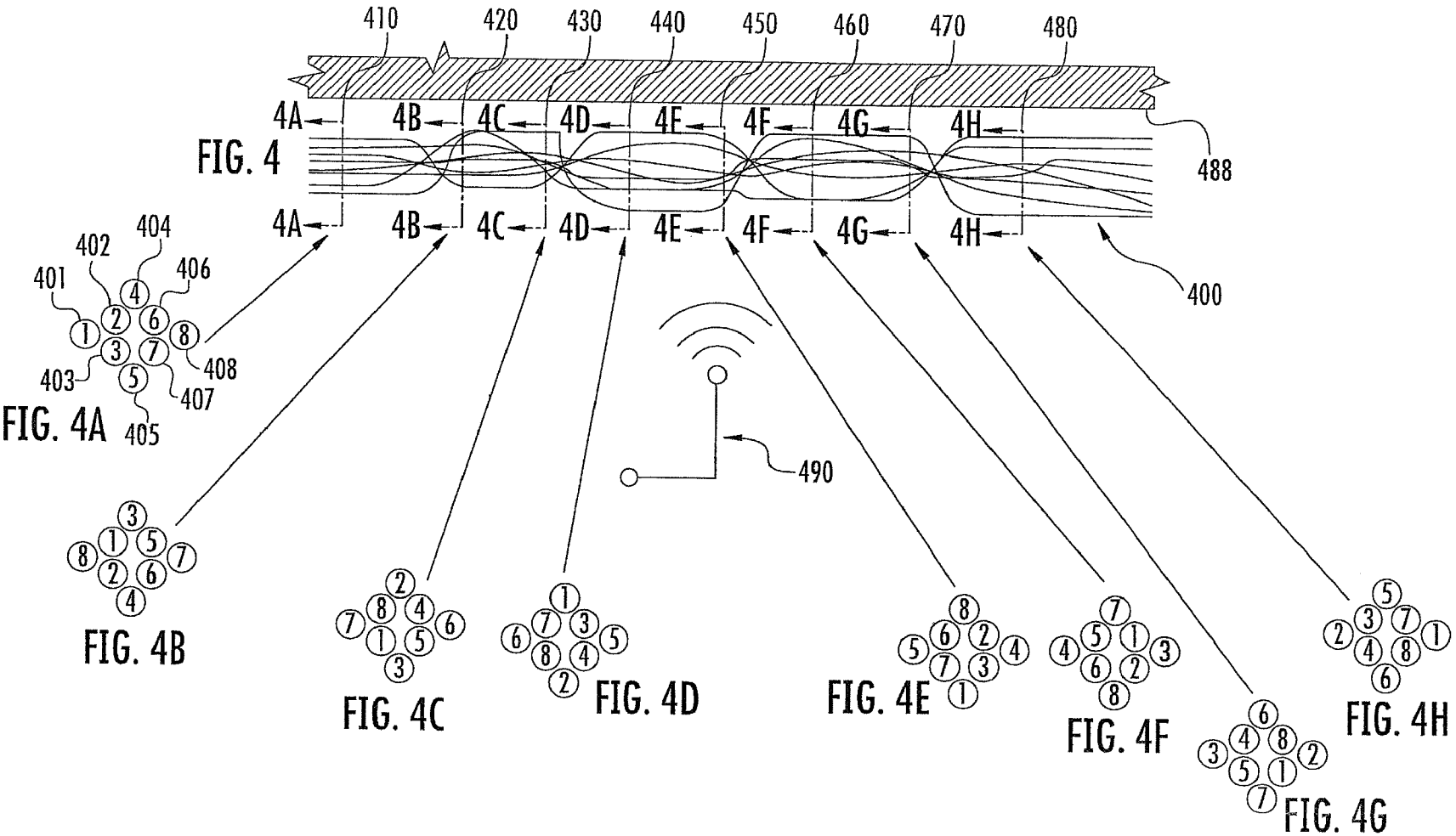
FIG. 4 is side elevational view of a wiring strand consisting of eight (8) conductor windings in accordance with one embodiment of the present invention.
FIG. 4*a* is cross-sectional view of the wiring strand of FIG. 4, taken along line 4*a*-4*a*.
FIG. 4*b* is cross-sectional view of the wiring strand of FIG. 4, taken along line 4*b*-4*b*.
FIG. 4*c* is cross-sectional view of the wiring strand of FIG. 4, taken along line 4*c*-4*c*.
FIG. 4*d* is cross-sectional view of the wiring strand of FIG. 4, taken along line 4*d*-4*d*.
FIG. 4*e* is cross-sectional view of the wiring strand of FIG. 4, taken along line 4*e*-4*e*.
FIG. 4*f* is cross-sectional view of the wiring strand of FIG. 4, taken along line 4*f*-4*f*.
FIG. 4*g* is cross-sectional view of the wiring strand of FIG. 4, taken along line 4*g*-4*g*.
FIG. 4*h* is cross-sectional view of the wiring strand of FIG. 4, taken along line 4*h*-4*h*.

Referring now to FIG. 4, a given length of a first embodiment of an eight (8) conductor wiring strand 400 is shown disposed in proximity to a ferromagnetic core structure 488. Cross-sectional views (FIGS. 4*a*-4*h*) are illustrated for eight (8) substantially equally spaced positions along the woven wiring strand. Looking at these cross-sections along the wiring strand, the wiring strand group can be thought of as consisting of eight (8) different discrete conductor positions within the woven strand. The number of discrete conductor positions is of course arbitrary (as the braid itself is of course not of a discrete nature); however, choosing a number that is equal with the number of conductors within a given wiring strand group offers a convenient method for discussing the principles of the present invention. This is primarily because with an adequate weaving technique, a given conductor should reside on average equally throughout the woven grouping as any other conductor within the group. See for example, Table 1 below. Accordingly, a given conductor would ideally occupy each discrete position equally over a given length of wire such that the average position of a conductor within the woven grouping would be the same for each of the conductors. This is at least partly attributable to the nature of the use of an adequate weaving technique in which the braids themselves provide the underlying structure that supports and controls the positioning of the individual conductors throughout the strand. Consequently, the use of a weaving technique as a means to group the conductors together also serves to maintain the individual conductors in their desired positions in a predictable fashion. In other words, the individual conductors are not easily disturbed from their desired positions if the weaving technique utilized is sufficiently dense.

Looking now towards the specific example illustrated in FIGS. 4-4*h*, at the first location 410 along the strand (FIG. 4*a*), the first conductor (labeled as "1") is positioned at the first conductor position 401, while the second conductor (labeled as "2") is positioned at the second conductor position 402, and so forth for each of the various conductors and conductor positions throughout the wiring strand. The period length for the wiring strand is defined as the length of wiring strand needed in order for a given conductor (e.g. the first conductor) to advance through each of the various conductor positions throughout the braid (i.e., one through eight (1-8) in the illustrated embodiment), and return back to its original conductor position within the wiring strand.

Figure 2:
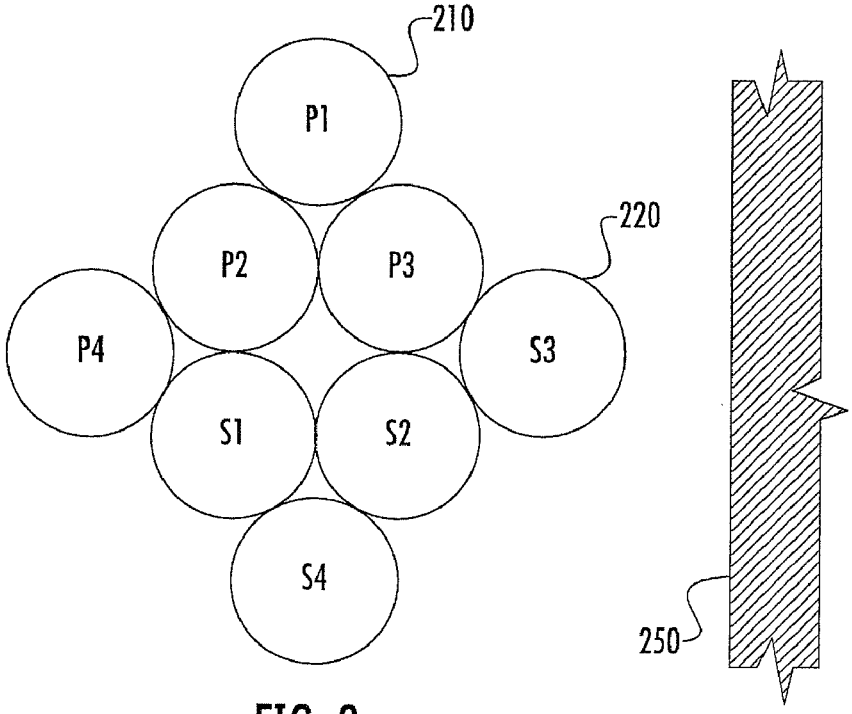
FIG. 2 (PRIOR ART)
FIG. 2 is a cross sectional view illustrating an exemplary eight (8) conductor winding for a prior art 10GBaseT transformer.
Figures 3, 3A, 3B, 3C, 3D, 3E:
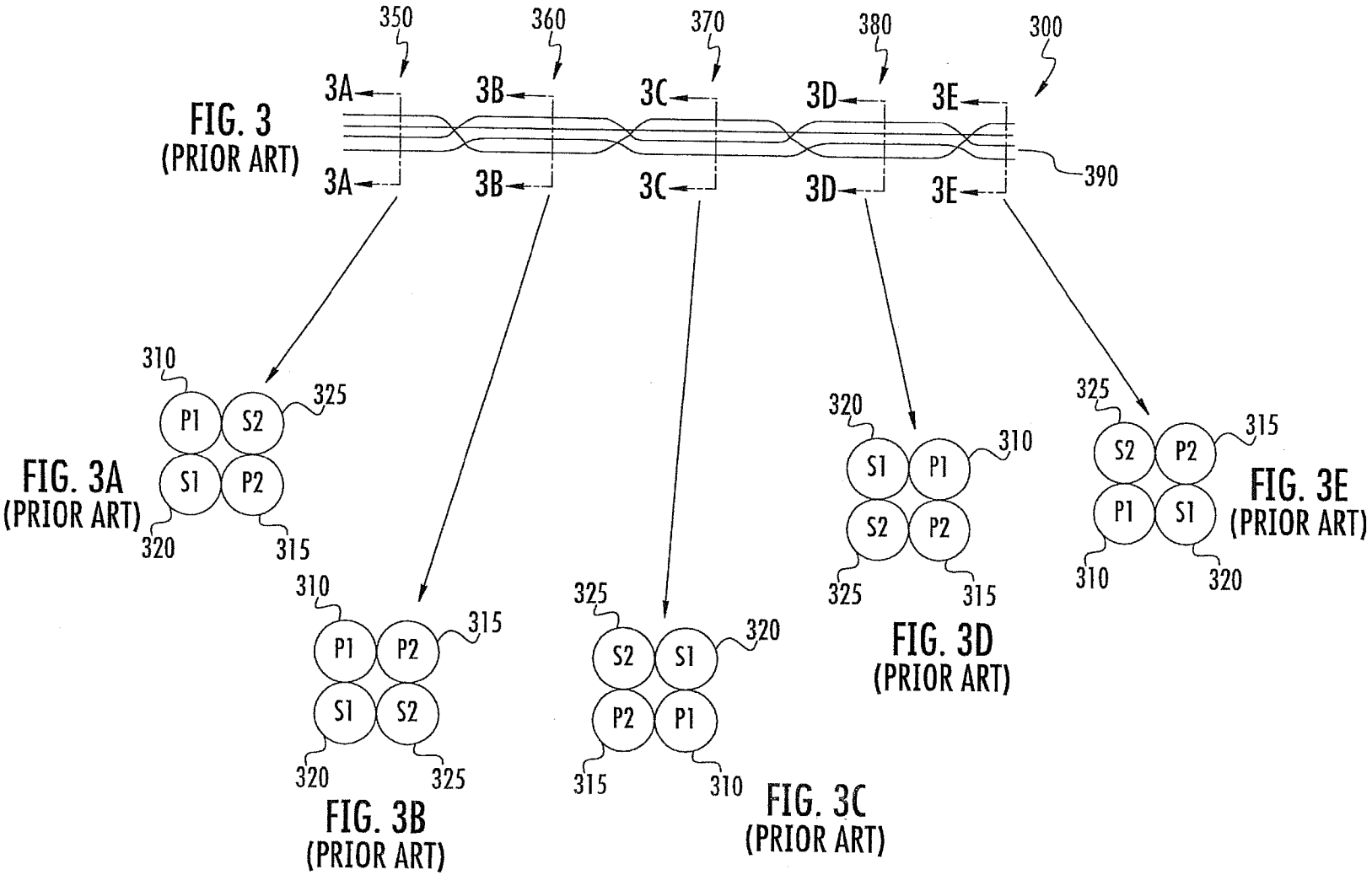
FIG. 3 (PRIOR ART)
FIG. 3A (PRIOR ART)
FIG. 3B (PRIOR ART)
FIG. 3C (PRIOR ART)
FIG. 3D (PRIOR ART)
FIG. 3E (PRIOR ART)
FIG. 3 is side elevational view of a prior art wiring strand consisting of four (4) conductor windings.
FIG. 3*a* is cross-sectional view of the wiring strand of FIG. 3, taken along line 3*a*-3*a*.
FIG. 3*b* is cross-sectional view of the wiring strand of FIG. 3, taken along line 3*b*-3*b*.
FIG. 3*c* is cross-sectional view of the wiring strand of FIG. 3, taken along line 3*e*-3*c*.
FIG. 3*d* is cross-sectional view of the wiring strand of FIG. 3, taken along line 3*d*-3*d*.
FIG. 3*e* is cross-sectional view of the wiring strand of FIG. 3, taken along line 3*e*-3*e*.

A significant benefit of the illustrated embodiment of the eight (8) conductor wiring strand 400 over prior art twisting and interleaved wiring strands (such as that depicted in FIG. 2) is that each conductor within the wiring strand is woven so as to exist, on average, at the same distance from: (1) the ferromagnetic core 488; and (2) various ones of external radiation sources 490. In other words, each conductor within the woven strand theoretically exists on average in the same physical location as any other conductor over a period length of the strand. Table 1 below shows a first exemplary weaving implementation that illustrates the above-described principle as various conductors advance through various conductor positions for a single period length of the wiring strand 400.

TABLE 1

First Conductor Position Order Example

| Conductor Positions | First Location (410)-FIG. 4a | Second Location (420)-FIG. 4b | Third Location (430)-FIG. 4c | Fourth Location (440)-FIG. 4d | Fifth Location (450)-FIG. 4e | Sixth Location (460)-FIG. 4f | Seventh Location (470)-FIG. 4g | Eighth Location (480)-FIG. 4h |
|---|---|---|---|---|---|---|---|---|
| 401 | C1 | C8 | C7 | C6 | C5 | C4 | C3 | C2 |
| 402 | C2 | C1 | C8 | C7 | C6 | C5 | C4 | C3 |
| 403 | C3 | C2 | C1 | C8 | C7 | C6 | C5 | C4 |
| 404 | C4 | C3 | C2 | C1 | C8 | C7 | C6 | C5 |
| 405 | C5 | C4 | C3 | C2 | C1 | C8 | C7 | C6 |
| 406 | C6 | C5 | C4 | C3 | C2 | C1 | C8 | C7 |
| 407 | C7 | C6 | C5 | C4 | C3 | C2 | C1 | C8 |
| 408 | C8 | C7 | C6 | C5 | C4 | C3 | C2 | C1 |

Note that while the illustrated sequencing of the various conductors in Table 1 is sequential (i.e., for example the first conductor (C1) advances through the various conductor positions in a sequential order), it is contemplated that the specific weaving techniques utilized within the conductors are not so limited. In fact, virtually any weaving scheme can be utilized which accomplishes the principles as discussed above. For example, and as an alternative weaving technique to that described above, another method might result in the advancement through the conductor positions in a non-sequential order (e.g., each conductor skips two (2) conductor positions at each of the sequential locations 410-480 along the strand group). Table 2 illustrates one such possible implementation.

TABLE 2

Second Conductor Position Order Example

| Conductor Position | First Location (410) | Second Location (420) | Third Location (430) | Fourth Location (440) | Fifth Location (450) | Sixth Location (460) | Seventh Location (470) | Eighth Location (480) |
|---|---|---|---|---|---|---|---|---|
| 401 | C1 | C6 | C3 | C8 | C5 | C2 | C7 | C4 |
| 402 | C2 | C7 | C4 | C1 | C6 | C3 | C8 | C5 |
| 403 | C3 | C8 | C5 | C2 | C7 | C4 | C1 | C6 |
| 404 | C4 | C1 | C6 | C3 | C8 | C5 | C2 | C7 |
| 405 | C5 | C2 | C7 | C4 | C1 | C6 | C3 | C8 |
| 406 | C6 | C3 | C8 | C5 | C2 | C7 | C4 | C1 |
| 407 | C7 | C4 | C1 | C6 | C3 | C8 | C5 | C2 |
| 408 | C8 | C5 | C2 | C7 | C4 | C1 | C6 | C3 |

While various examples and permutations are possible, the underlying principle of the sequence should guide a result in which for a given conductor within a wire strand group comprised of multiple conductors, the average position within the woven wiring strand for that conductor, over a period length of the strand, should be predictable and approximately the same for each conductor within the wiring strand group. The use of various weaving techniques offers a convenient mechanism for ensuring this "average distance" relationship for each of the conductors within the wiring strand group. While the embodiment illustrated in FIG. 4 utilizes eight (8) conductors, it is appreciated that various weaving techniques can be used for virtually any number of conductors, whether even or odd. For example, in a transformer configuration with no center tap on the primary winding, an even number of conductors for the primary can be used. However, the secondary winding on this particular configuration does include a transformer center tap, and accordingly will conveniently use an odd number of conductors consisting of at least three (3) conductors. Accordingly, the total number of conductors used in this example would be an odd number.

As yet another example, various degrees of interleaving are utilized which would require an odd number of conductors for a transformer application. Specifically, the primary winding could be interleaved between the secondary windings (e.g. 1:2 ratios for primary to secondary) or alternatively, the secondary winding could be interleaved between the primary windings (e.g. 2:1 ratios for primary to secondary), each resulting in an odd number of conductors.

It will further be recognized that while the various embodiments disclosed herein generally obey the foregoing rule of "same average placement or distance over a period for all conductors", this is not a strict requirement of practicing the invention. For instance, it may be that within a weave of say eight (8) conductors, only four of the eight are critical or susceptible to the deleterious effects previously described (e.g., four of the eight are used for some other less critical or insensitive purpose). Hence, the present invention contemplates that weaving techniques may achieve the desired objective (e.g., average equalization over a period) for only a subset or portion of the total number of conductors in the strand.

Moreover, it is recognized that the aforementioned average equalization property may take on different periodicities for different conductors. For instance, in one such variant, a multi-stranded conductor may be woven so that equalization occurs for a portion of the conductors with a period of L inches, whereas the equalization occurs for the remaining conductors at a period of 2 L inches (or some other fraction/multiple relationship).

Yet another advantage of the application of weaving techniques to conductors within an electronic device application is the collective mechanical strength of the woven conductors (versus prior art twisting and interleaving techniques). Specifically, it is known that a braid has more tensile strength than a mere "twist". This strength means that smaller gauge conductors can be used which possess both mechanical and electrical advantages over larger gauge conductors in certain device applications. For example, this is useful in applications where the woven strand is utilized as the functional equivalent to a single conductor, etc.

Figure 5:
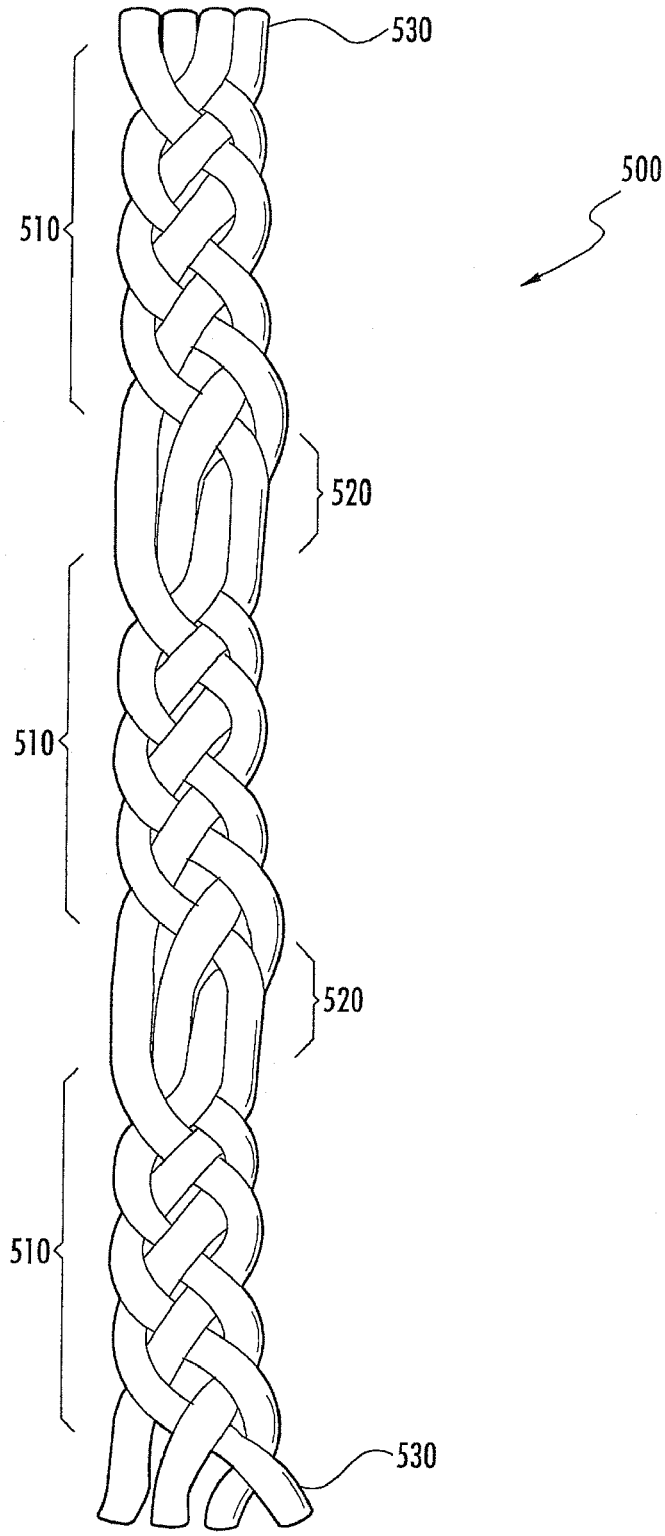
FIG. 5 is a perspective view of a segmented four-conductor woven wiring strand in accordance with another embodiment of the present invention.

Referring now to FIG. 5, a given length of a segmented woven wiring strand 500 consisting of four (4) conductors is illustrated. The wiring strand of FIG. 5 is different than the embodiment illustrated in FIG. 4, in that the wiring strand of FIG. 5 includes both woven portions 510 and non-woven portions 520, 530. The woven portions of the wiring strand are similar to that illustrated in FIG. 4, in that for each given conductor within the strand group, the average position for any conductor over a period length of the braid is approximately the same for each conductor within the wiring strand. However, the length of the woven portions has been chosen to coincide with a particular inductive device design. For example, in an inductive device that utilizes a bobbin with a diameter d and a fixed number of turns t, the length of winding 1 needed to fill that bobbin with a single layer of windings would be governed by equation (1) below:

$$l=t*d*p \qquad \text{(Eqn. 1)}$$

Where:

l=length of the winding t=number of turns d=bobbin diameter

Accordingly, the length of the woven portion of wire in this particular bobbin application would be set equal to the length l. A benefit of such an approach is that by dividing up the wiring strand into both woven and unwoven portions, an operator would not need to have to de-braid a woven portion of the wiring strand in order to terminate the wiring strand ends 530 to the terminals on the bobbin. This is a particularly significant advantage in implementations that utilize a large number of conductors and/or small diameter (i.e. small gauge) conductors, as the de-braiding operation would quickly consume a significant amount of operator time, thereby substantially increasing the cost of the device. Furthermore, such a configuration is also well suited for automated winding operations, in that the intermediate portions 520 of non-woven windings could be trimmed either automatically or manually, and thereafter are immediately ready for winding onto the next bobbin.

In addition to implementations in which the non-woven portions are cut, it is also envisioned that the non-woven portions can also be used to facilitate the intermediate termination of the windings (e.g. a transformer center tap) without necessitating the de-braiding of the woven conductor wiring strand.

Examples of devices which can utilize the woven conductors include bobbins such as those described in U.S. Pat. No. 5,952,907 entitled "Blind hole pot core transformer device" issued Sep. 14, 1999, which is incorporated herein by reference in its entirety. In addition to so-called pot core bobbin devices, the present invention can be utilized in virtually any existing bobbin platform, including for instance those bobbins and devices described in U.S. Pat. No. 6,642,827 entitled "Advanced electronic microminiature coil and method of manufacturing" issued Nov. 4, 2003, which is incorporated herein by reference in its entirety.

While convenient for use on bobbins or formers, the segmented wiring strand also has broader utility on other electronic components, such as wound toroids. For example, the segmented wiring strand approach of FIG. 5 could also be utilized in automated winding equipment such as that disclosed in co-owned U.S. Pat. No. 3,985,310 issued Oct. 12, 1976 and entitled "Method for winding ring-shaped articles", the contents of which are incorporated herein by reference in its entirety. The length of the woven portions could easily be adjusted in order to, for example, accommodate the number of turns necessary for the particular application being used. Furthermore, due to the nature of the woven wiring strand (i.e., because it can readily be used in ways that existing conductors can be used such as in spools), the use of woven wiring strands can readily be incorporated into existing manufacturing methodologies.

In addition to its use with bobbins and toroidal devices, the woven conductor of the present invention may also be used in so-called form-less devices such as those described in U.S. Pat. No. 7,598,837 entitled "Form-less electronic device and methods of manufacturing" issued Oct. 6, 2009, which is incorporated herein by reference in its entirety. Furthermore, the woven wiring strands of the present invention can also be used in applications outside of the use of discrete electronic components, including for the transmission of voice and/or data as an alternative to data cabling such as Category 6 cable, etc.

EXAMPLE No. 1

Figure 6:
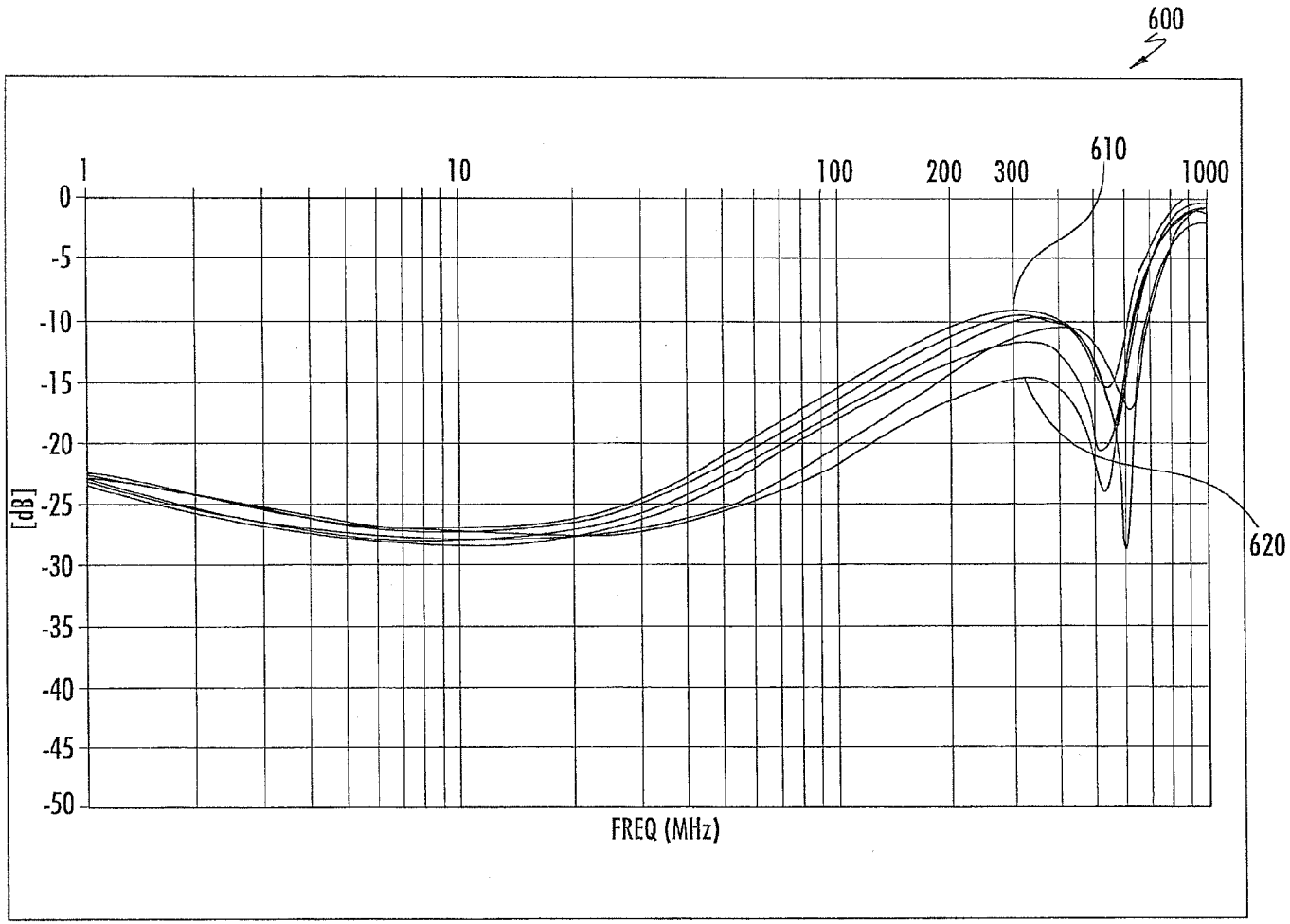
FIG. 6 (PRIOR ART)
FIG. 6 is a plot showing return loss as a function of frequency for a prior art 10 GBase-T magnetics module using eight (8) twisted conductors.
Figure 7:
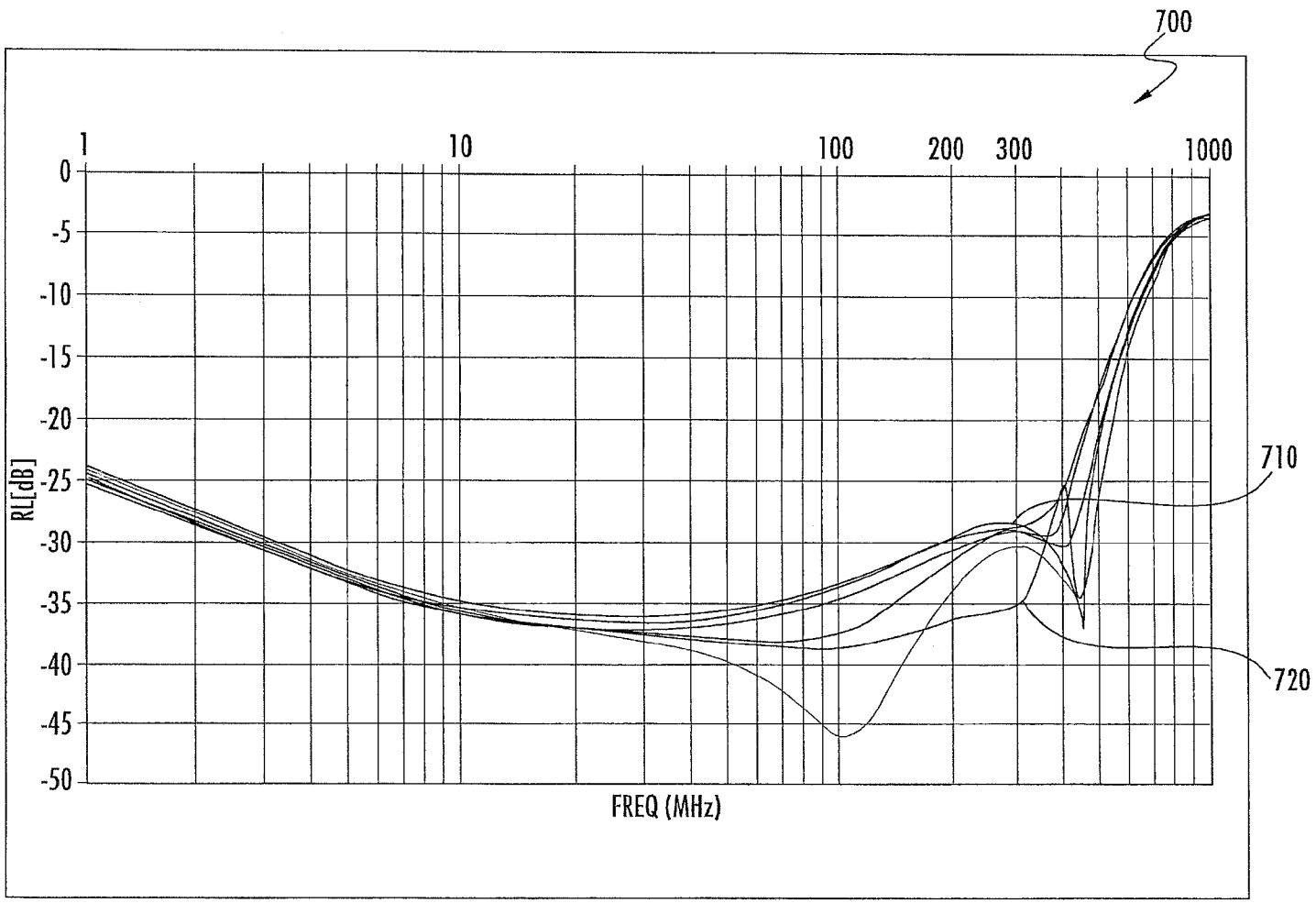
FIG. 7 is a plot showing return loss as a function of frequency for a 10 GBase-T magnetics module using eight (8) woven conductors in accordance with the principles of the present invention.

Referring now to FIGS. 6 and 7, exemplary plots illustrating return loss as a function of frequency for 10 GBase-T magnetics modules that are used in support of 10 GBase-T transceivers are shown. Specifically, FIG. 6 illustrates plots for eight (8) different channels that utilize prior art twisted and interleaved conductors within the toroidal inductive devices, while FIG. 7 illustrates eight (8) different channels for an identical device that utilizes woven conductors in accordance with the principles of the present invention.

As can be seen in FIG. 6, prior art return loss performance 600 is shown on a logarithmic scale from a frequency of about 1 MHz up to a frequency of 1000 MHz and in particular, the woven conductor methodology is compared with the prior art at a frequency range of approximately 300 MHz. On the low end 610 of the prior art twisted and interleaved device, return loss performance at 300 MHz is at about −9 dB, while on the high end 620, return loss performance at 300 MHz is at roughly −15 dB.

Compare the prior art device return loss performance and variation illustrated in FIG. 6 with the return loss performance 700 shown in FIG. 7 associated with a device manufactured with woven conductors according to the present invention. Specifically, with the woven conductor apparatus, the low end 710 return loss performance is at approximately −28 dB, while high end 720 return loss performance is roughly −35 dB or better. Accordingly, very significant benefits can be seen in the device which utilizes woven conductor winding techniques as compared with conventional twisted/interleaved winding techniques, with little or marginal additional time and cost associated with manufacturing such a device. While improvement for the electrical performance of a device using the woven conductor winding techniques described herein was reasonably expected, the magnitude of the improvement seen in the exemplary 10 GBase-T modules described herein was quite unexpected. Electrical performance, especially at relatively higher frequencies (here 200-300 MHz), was markedly improved over use of prior art twisting/interleaving winding techniques. Furthermore, not only was overall performance improved via the use of woven conductors, performance variations between devices were also significantly reduced for those 10GBase-T devices that used woven conductors. Accordingly, the combination of improved overall performance and consistency ultimately translates into (i) increased production yields for the device, and (ii) associated lower overall part costs and increased design margins for the integrated circuit vendors and network interface device manufacturers that use such magnetics modules as shown in FIG. 7. Furthermore, in specific applications such as in data telecommunications equipment, this improved overall performance results in increased reach for the data on the cable as well as reduced power consumption for the telecommunications equipment which utilizes these magnetic modules as this equipment will require less echo cancellation due to the vastly improved return loss performance.

Methods of Manufacture for Woven Conductor Apparatus

Figure 8:
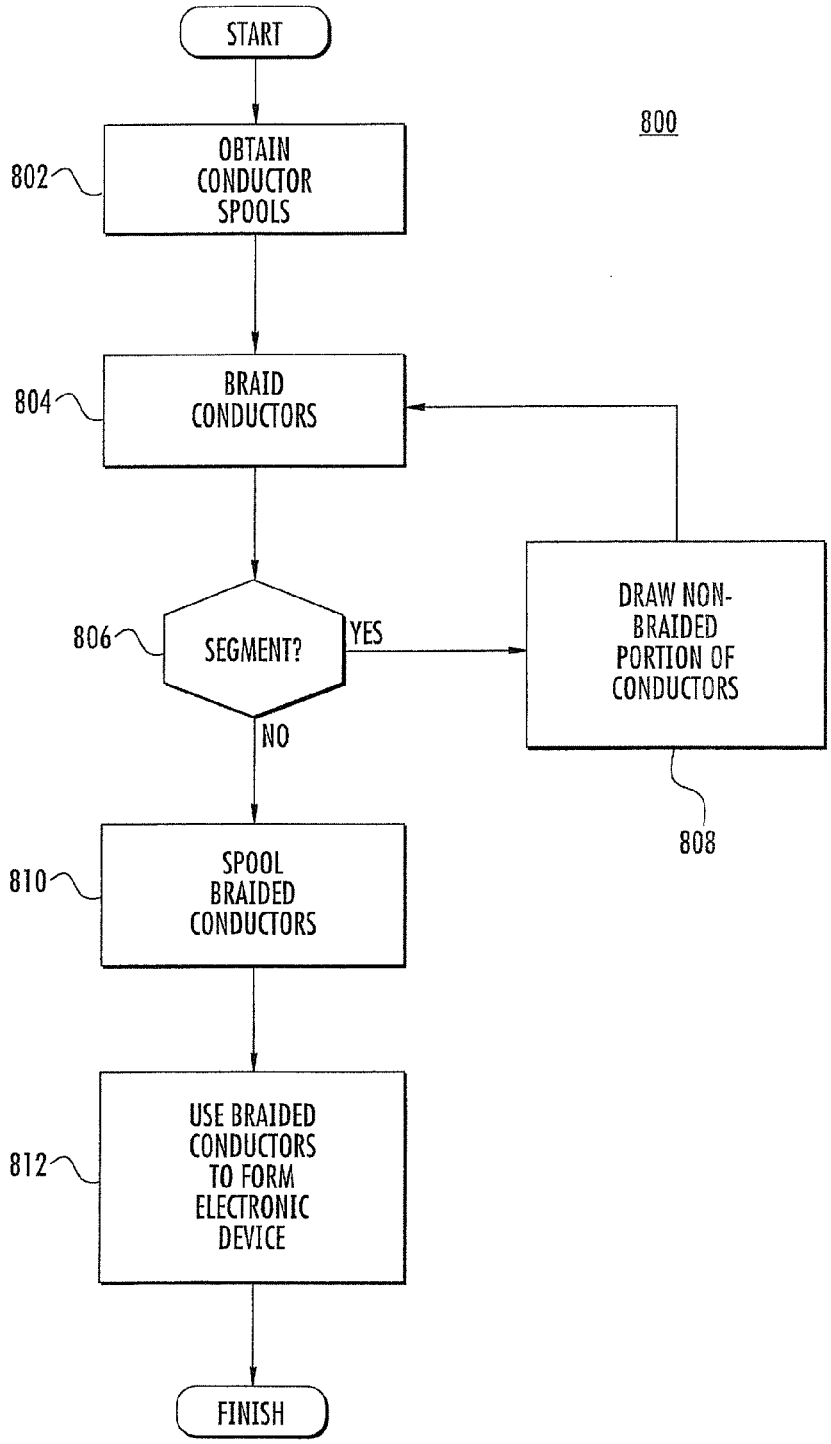
FIG. 8 is a process flow illustrating a first exemplary embodiment for manufacturing a woven conductor wiring strand.

Referring now to FIG. 8, an exemplary process flow diagram illustrating a first exemplary method of manufacturing and using a woven wiring strand is shown and described in detail. At step 802, spools containing the conductors to be used in the woven wiring strand are obtained. In an exemplary embodiment, the spools are purchased from the manufacturer of the conductors. Alternatively, the spools of conductors are manufactured directly by, for example, placing a non-conductive coating onto a copper conductor and spooling the resultant coated conductor onto a spool.

At step 804, the conductors obtained in step 802 are woven together. In one implementation, a given number of spools (e.g. four (4), eight (8), etc.) are disposed so that they are substantially adjacent to one another. An automated braiding machine subsequently draws the conductors from respective spools and braids them into a predetermined pattern. One such manufacturer of an automated braiding machine which can be utilized for manufacturing the woven windings that are utilized in the present invention is Steeger USA, LLC (http://www.steegerusa.com/). The particulars for one embodiment of winding a four (4) and eight (8) braided conductor are described subsequently herein with regards to FIG. 9. Alternatively, the braiding is performed manually by an operator who draws the conductor from the spools obtained at step 802 in a prescribed pattern.

At step 806, it is determined whether or not the woven windings are to be segmented as discussed previously herein with respect to FIG. 5. If so, a first given length of conductors are woven at step 804 and then a second given length of conductors are drawn from the obtained spools at step 808. As an example, both the first and second given lengths are determined based on the ultimate end applications in which the woven conductor wiring strand is to be used in order to facilitate the manufacture of the end product. Steps 804, 806 and 808 are repeated as is necessary to satisfy a predetermined spool configuration. In addition to static configurations, the length of the first and second given lengths can vary depending on the desired configuration of the segmented woven wiring strand spool or spools.

If at step 806, the woven conductor is not to be segmented, then the woven wiring strand is simply spooled at step 810. This spool of woven wiring strand can then be packaged and labeled so as to identify the configuration used on the spool.

At step 812, the spool of woven conductor wiring strand is optionally used to form an electronic device. For example, the woven wiring strand can be used to wind a ferrite core. The wound ferrite core is then subsequently inserted into a microelectronic component package such as that described in U.S. Pat. No. 6,225,560 entitled "Advanced electronic microminiature package and method" issued May 1, 2001, which IS incorporated herein by reference in its entirety. Alternatively, the woven conductor wiring strand can be used in any number of known electronic device packages that use conductive wire such as bobbins or formers, headers and the like.

Figure 9:
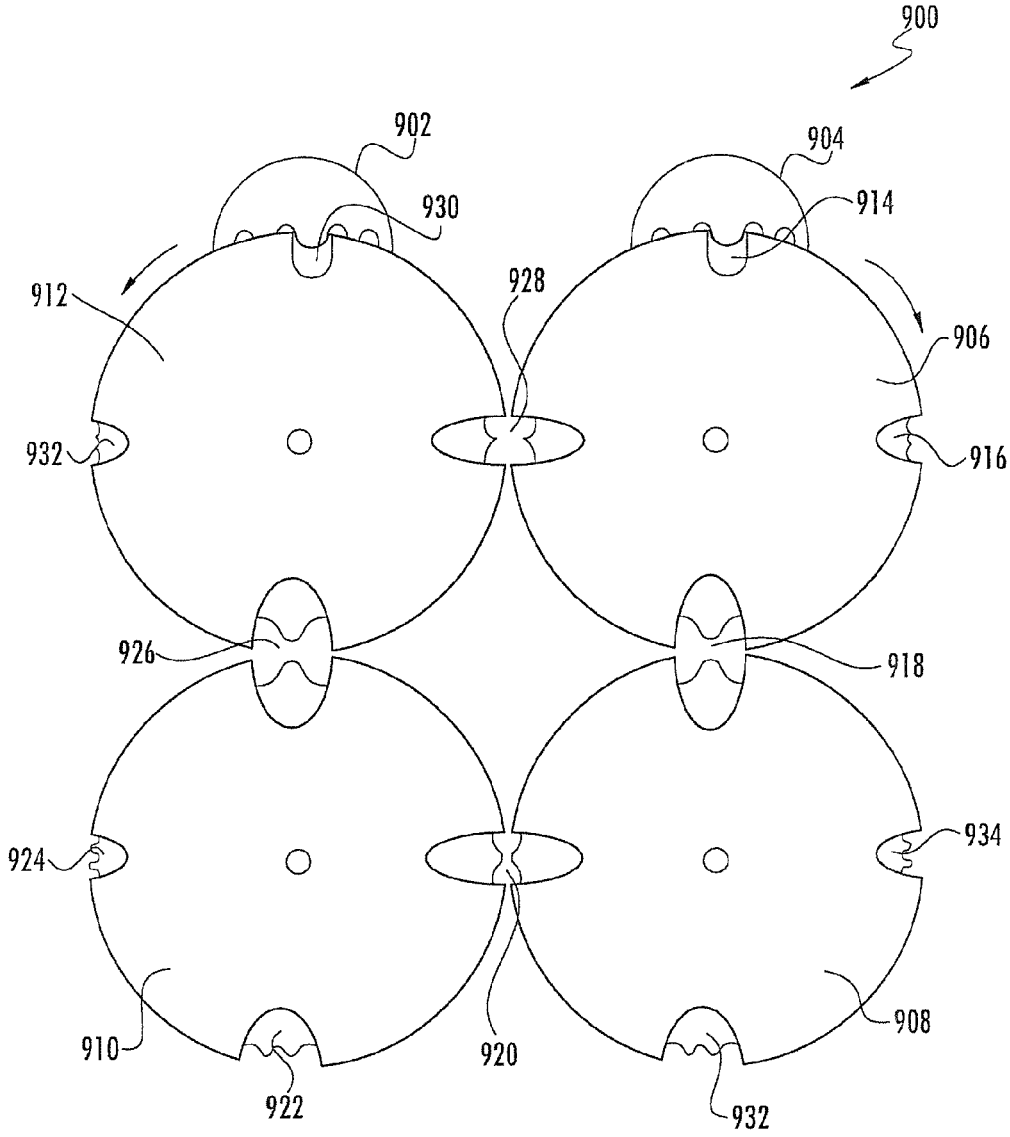
FIG. 9 is an elevation view of the winding head of an exemplary eight (8) carrier braiding machine useful with the present invention.

Referring now to FIG. 9, one exemplary braiding machine head 900 for an eight (8) carrier braiding machine useful in manufacturing both four (4) and eight (8) wire braids is shown and described in detail. While the exemplary apparatus of FIG. 9 is based on a customized machine manufactured by Steeger USA, LLC of Inman, S.C., it will be appreciated that other types, configurations, and/or manufacturers of braiding apparatus may be used with the invention with equal success, the Steeger design being only illustrative of the broader principles.

With regards to the manufacture of four (4) wire braids, the process starts with two (2) wires that travel in a clockwise (CW) direction and two (2) wires that travel in a counterclockwise (CCW) direction. These wires then intermesh in a one over one under pattern. In other words one wire travelling CW will pass over the first wire that is travelling in the CCW direction and then under the second wire travelling in the CCW direction. This same wire will then repeat this pattern while the second wire travelling in the CW direction will start by passing under the first CCW wire and over the second CCW wire. To achieve this pattern the carriers are loaded into the braiding machine as follows.

The first CW wire carrier is loaded through the loading gate 904 and into the 'Lock' 914 on horn gear 906. As the horn gears rotate the carrier will pass from the outside of horn gear 906 to the inside of horn gear 908 at position 918. The carrier will transfer from the inside of horn gear 908 to the outside of horn gear 910 at position 920. When the carrier reaches position 922 the second CW wire carrier will be inserted through loading gate 904 and into position 914. The loading plate (not shown) is then inserted and secured into the loading gate 904. The carriers that are to run in the CCW direction will then be loaded through loading gate 902 starting with a first CCW wire carrier. The horn gears are then rotated until the first and second CW wire carriers loaded above are at positions 916 and 924, respectively. A fourth CCW wire carrier is then inserted into position 930 and subsequently rotated until the first CW wire carrier is at position 932. The loading plate (not shown) is then inserted and secured into loading gate 902.

Eight (8) wire braided conductors consist of four (4) wires travelling CW and four (4) wires travelling CCW. These wires intermesh in a one over two (2) under two (2) pattern. That is one wire travelling CW will pass over the first two (2) wires that are travelling in the CCW direction and then under the second two (2) wires travelling in the CCW direction. This same wire will then repeat this pattern while the second wire travelling in the CW direction will repeat this pattern, but start one wire later in the pattern. To achieve this pattern the carriers are loaded into the braiding machine as follows.

The first CW wire carrier is loaded through loading gate 904 and into the 'Lock' 914 on horn gear 906. As the horn gears rotate the first CW wire carrier will pass from the outside of horn gear 906 to the inside of horn gear 908 at position 918. The horn gears will continue to rotate and the first CW wire carrier will transfer from the inside of horn gear 908 while a second CW wire carrier is then inserted. The first CW wire carrier will then go to the outside of horn gear 910 at position 920. When the first CW wire carrier reaches position 922 the third CW wire carrier will be inserted through loading gate 904 and into position 914. The carriers continue to be rotated until the first CW wire carrier reaches position 926 between horn gear 910 and horn gear 912 where the fourth CW wire carrier is inserted and rotated. The loading plate (not shown) is then inserted and secured into the loading gate 904.

The wire carriers that are to run in the CCW direction will be loaded through loading gate 902 with the CW wire carriers loaded above now at positions 916, 920, 924 and 928, respectively. A first CCW wire carrier is inserted into position 930 and is rotated until it reaches position 926, when the second CCW wire carrier is loaded. The second CCW carrier is advanced to position 932 when a third CCW wire carrier is loaded. The first CCW wire carrier is advanced to position 918 when the fourth CCW wire carrier is then loaded at position 930. The loading plate (not shown) is then inserted and secured into the loading gate 902.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device, comprising:

a plurality of conductive windings comprised of a primary sub-group and a secondary sub-group;

wherein at least said primary and secondary sub-groups are at least partly woven; and wherein the at least said primary and secondary sub-groups are at least partly woven such that at least a portion of the plurality of conductive windings reside on at least three distinct levels within the at least partly woven structure.

2. The inductive device of claim 1, wherein the woven portion of said conductive windings is configured so that each conductive winding within said woven portion resides, on average, equally throughout said woven portion over a given period length.

3. The inductive device of claim 2, further comprising a ferromagnetic core, said plurality of conductive windings being disposed about said ferromagnetic core.

4. The inductive device of claim 3, wherein said ferromagnetic core comprises a toroid.

5. The inductive device of claim 4, wherein each conductive winding within said woven portion resides, on average, the same distance away from said ferromagnetic core.

6. The inductive device of claim 1, wherein a total number of said plurality of conductive windings comprises an even number.

7. The inductive device of claim 1, wherein a total number of said plurality of conductive windings comprises an odd number.

8. The inductive device of claim 1, further comprising a bobbin, said plurality of conductive windings being disposed at least partly about said bobbin.

9. A segmented woven wiring strand, comprising:

a plurality of conductive wires that are bundled together over a given length;

wherein the conductive wires are comprised of a plurality of woven portions and a plurality of non-woven portions; and wherein at least one of the non-woven portions resides between two adjacent woven portions.

10. The segmented woven wiring strand of claim 9, wherein the woven portion of said conductive wires is configured so that each conductive wire within said one or more woven portions resides, on average, equally throughout said woven portion over a given period length.

11. The segmented woven wiring strand of claim 9, wherein a total number of said plurality of conductive wires comprises and even number.

12. The segmented woven wiring strand of claim 9, wherein a total number of said plurality of conductive wires comprises an odd number.

13. The segmented woven wiring strand of claim 12, wherein the woven length permits an operator used in the manufacture of said particular inductive device to not have to de-braid a woven portion of the segmented woven wiring strand.

14. The segmented woven wiring strand of claim 9, wherein a woven length for said one or more woven portions is selected to coincide with at least one dimension of a particular inductive device.

15. A method of manufacturing an inductive device, comprising:

obtaining an electronic component element;

obtaining a woven wiring strand comprised of a plurality of conductive wires disposed within three or more discrete layers; and disposing said woven wiring strand about said electronic component element.

16. The method of claim 15, wherein said woven wiring strand comprises both woven and un-woven portions.

17. The method of claim 15, wherein said woven wiring strand further comprises a period length, and is further divided into a plurality of equally spaced positions along said period length.

18. The method of claim 17, wherein the plurality of equally spaced positions comprises a number equal to a number of conductive wires within said woven wiring strand.

19. The method of claim 18, wherein a given conductive wire occupies a different position within said strand at each of said equally spaced positions such that, on average, said given conductive wire resides substantially at the center of said woven wiring strand.

20. The method of claim 19, wherein each of said conductive wires resides, on average, substantially at the center of said woven wiring strand over said period length.

21. An inductive device having an electronic component element, the inductive device being manufactured by the method comprising:

obtaining a woven wiring strand comprised of a plurality of conductive wires, said woven wiring strand having a height that is substantially equal with a width of said woven wiring strand; and disposing said woven wiring strand about said electronic component element.

22. The inductive device of claim 21, wherein said woven wiring strand comprises both woven and un-woven portions.

23. The inductive device of claim 22, wherein said woven wiring strand further comprises a period length, and is further divided into a plurality of equally spaced positions along said period length.

24. The inductive device of claim 23, wherein the plurality of equally spaced positions comprises a number equal to a number of conductive wires within said woven wiring strand.

25. The inductive device of claim 24, wherein a given conductive wire occupies a different position within said strand at each of said equally spaced positions such that, on average, said given conductive wire resides substantially at the center of said woven wiring strand.

26. The inductive device of claim 21, wherein each of said conductive wires resides, on average, substantially at the center of said woven wiring strand over a given period length.

* * * * *